United States Patent [19]

Rickman

[11] 4,083,678

[45] Apr. 11, 1978

[54] ROTARY KILN

[75] Inventor: Tommy L. Rickman, Michie, Tenn.

[73] Assignee: Tennessee River Pulp & Paper Company, Counce, Tenn.

[21] Appl. No.: 739,310

[22] Filed: Nov. 5, 1976

[51] Int. Cl.[2] ..... F27B 9/18

[52] U.S. Cl. ..... 432/61; 432/18; 432/118

[58] Field of Search ..... 432/18, 61, 80, 118; 241/DIG. 26

[56] References Cited

U.S. PATENT DOCUMENTS

| | | | |
|---|---|---|---|
| 2,859,955 | 11/1958 | Petersen | 432/61 |
| 2,879,052 | 3/1959 | Azbe | 432/61 |
| 3,063,647 | 11/1962 | Lellep | 432/61 |

*Primary Examiner*—John J. Camby
*Attorney, Agent, or Firm*—John R. Walker, III

[57] ABSTRACT

A rotary kiln for treating material (e.g., for burning lime). The kiln includes a rotatable, hollow body for receiving material such as wet lime mud (i.e., limestone). The body has an opened end to allow the material to exit the body after it has been treated.A shroud is provided to cover the opened end of the body. The shroud includes a grate for allowing particles of the material of a certain maximum size to pass therethrough and includes a chute for allowing particles of the material of a size greater than the maximum size capable of passing through the grate to pass therethrough. A pair of outwardly extending arm members are fixedly attached to the opened end of the body for rotation therewith and for moving any particles of the material of a size greater than the maximum size capable of passing through the grate to the chute of the shroud for passage therethrough.

5 Claims, 4 Drawing Figures

FIG. 1
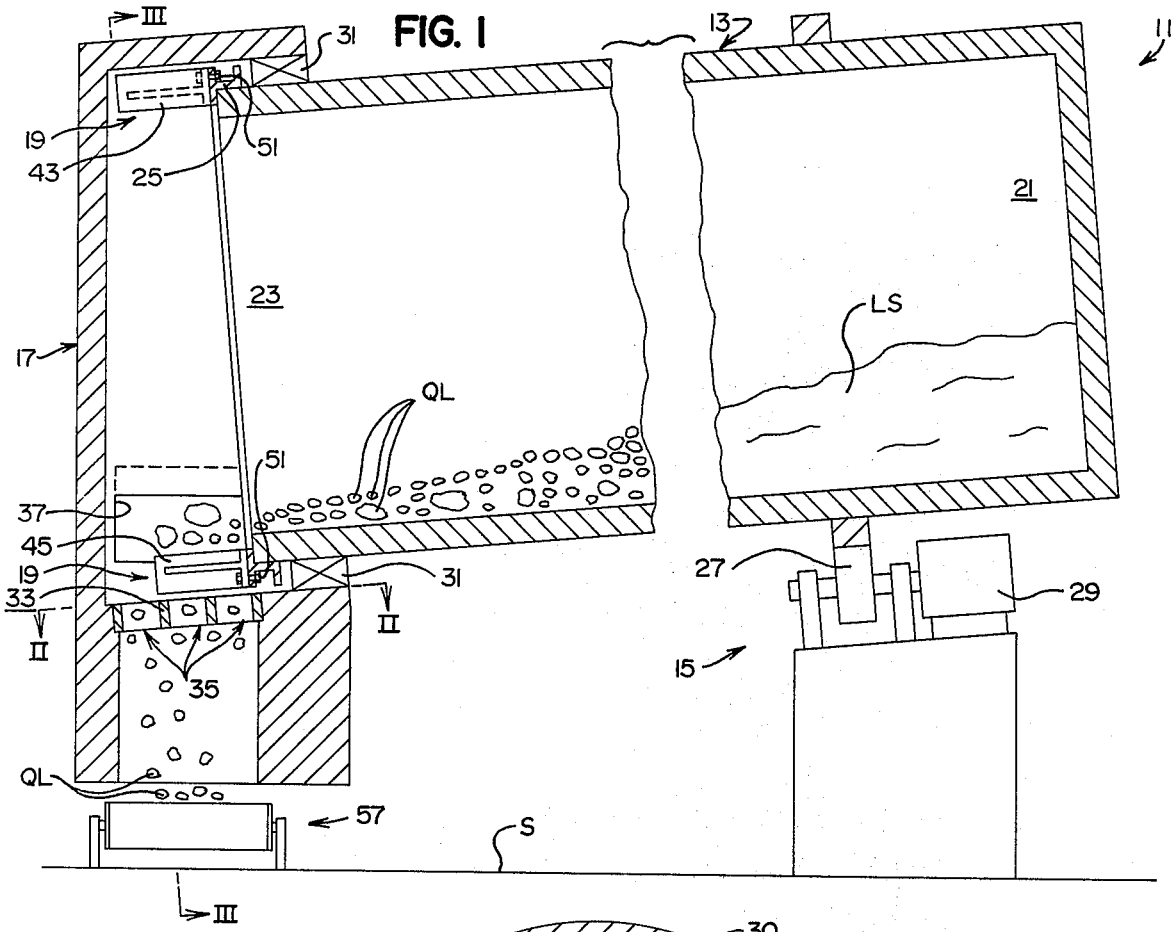
FIG. 2
FIG. 3
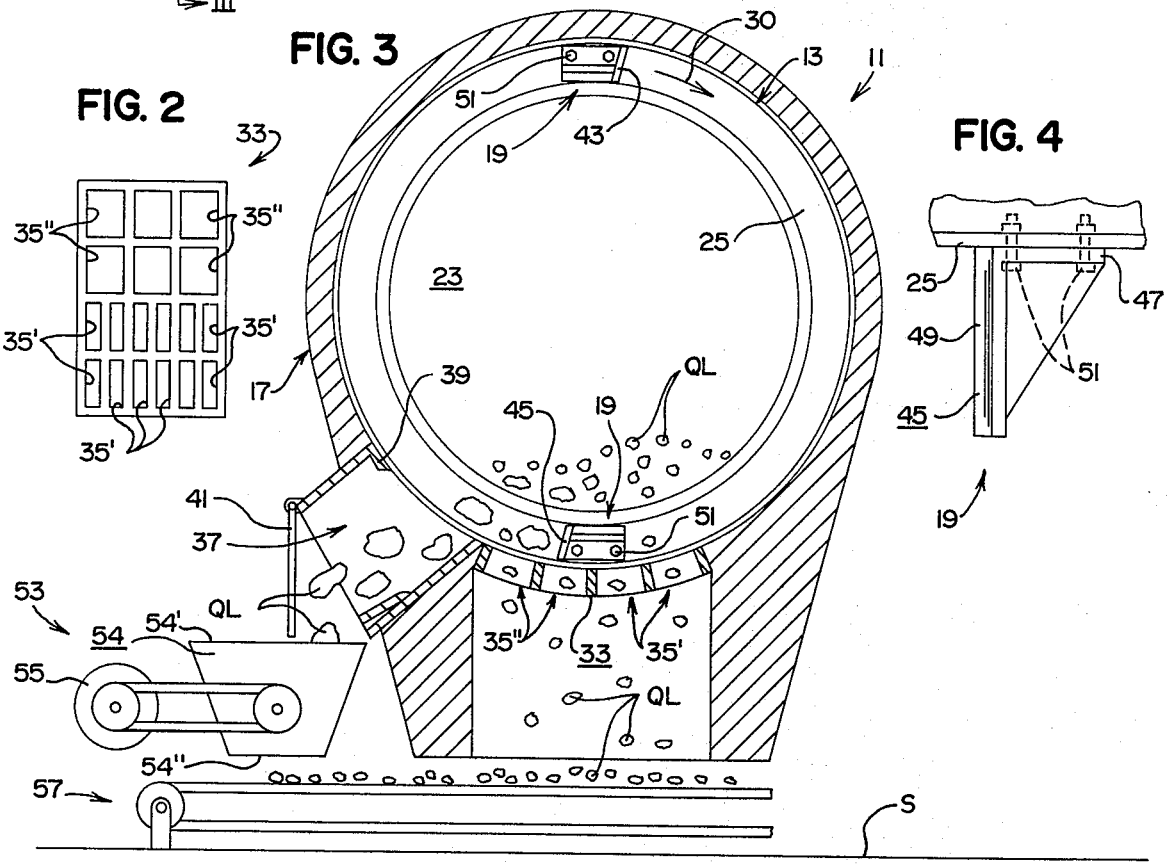
FIG. 4

ROTARY KILN

BACKGROUND OF THE INVENTION

1. Field of the Invention

This invention relates generally to rotary kilns and more specifically to improvements in such rotary kilns that aid in the removal of large lumps of material or the like from the interior of the kilns.

2. Description of the Prior Art

Rotary kilns are used for various purposes. For example, such rotary kilns are used in the paper mill industry for "burning lime", i.e., for heating calcium carbonate (limestone) to cause the calcium carbonate to decompose into calcium oxide (quicklime) and carbon dioxide. In such an operation, wet lime mud is introduced in the upper end of the rotary kiln and the lower end of the rotary kiln is fired with natural gas or oil. The burned quicklime exits from the lower end of the kiln in the form of particles ranging preferably from dust to 1 in. in diameter. Frequently, however, the lime mud congeals into larger particles which may range from three to four inches to two feet in diameter and these also tumble from the lower end of the kiln. Ordinarily, the lime particles pass through a grill or grate and are conveyed to a storage bin or the like. However, the large particles which cannot pass through the grill are retained on the grill at the lower end of the kiln and have to be removed manually by the operator of the kiln and transferred to a crusher or the like. The manual task of dragging these large lumps of lime from the hot fiery end of the kiln is a very taxing, unpleasant, and somewhat dangerous task.

Applicant is aware of the following U.S. patents which may be of interest: Tomlinson, U.S. Pat. No. 1,544,504; Phillips, U.S. Pat. No. 2,518,636; Harris, U.S. Pat. No. 3,124,338; Spence, U.S. Pat. No. 3,220,714; Smithwick, U.S. Pat. No. 3,604,692; Vering, U.S. Pat. No. 3,807,936; and Henning, U.S. Pat. No. 3,910,756. None of these patents disclose, teach or suggest the present invention.

SUMMARY OF THE INVENTION

The present invention is directed towards overcoming the problems and disadvantages of prior rotary kilns. The concept of the present invention is to provide a rotary kiln with means for automatically conveying large lumps of material from the lower end of the kiln to a crusher to eliminate the task of manually dragging the large lumps of material from the lower end of the kiln.

The rotary kiln of the present invention includes a hollow body means for receiving a quantity of material to be treated, the body means including an opened end for allowing the material to exit the body means after it has been treated; means for rotating the body means; shroud means for covering the opened end of the body means, the shroud means including grate means for allowing particles of the material of a certain maximum size to pass therethrough and including chute means for allowing particles of the material of a size greater than the maximum size capable of passing through the grate means to pass therethrough; and arm means fixedly attached to the body means for rotation therewith and for moving any particles of the material of a size greater than the maximum size capable of passing through the grate means to the chute means.

BRIEF DESCRIPTION OF THE DRAWINGS

FIG. 1 is a sectional side elevational view of the rotary kiln of the present invention with some portions shown broken away for clarity.

FIG. 2 is a plan view of the grate means of the rotary kiln of the present invention as taken on line II—II of FIG. 1 with some portions of the rotary kiln removed for clarity.

FIG. 3 is a sectional view of the rotary kiln of the present invention as taken on line III—III of FIG. 1.

FIG. 4 is a detailed plan view of an arm means of the present invention with some portions of the rotary kiln broken away for clarity.

DESCRIPTION OF THE PREFERRED EMBODIMENT

The rotary kiln 11 of the present invention is for use as a typical rotary kiln to treat material. For example, the rotary kiln 11 of the present invention is specifically adapted for use in "burning lime"—i.e., in heating calcium carbonate (limestone) to cause the calcium carbonate to decompose into calcium oxide (quicklime) and carbon dioxide for use in the paper mill industry. When the rotary kiln 11 is used in "burning lime", limestone LS preferably in the form of wet lime mud is placed within the rotary kiln 11 (see FIG. 1) and the rotary kiln 11 is fired with natural gas or oil in a manner well known to persons skilled in the art to cause the limestone LS to decompose into particles of quicklime QL (see FIGS. 1 and 2) as will be apparent to persons skilled in the art. The rotary kiln 11 includes, in general, a hollow body means 13 for receiving a quantity of the material (e.g., limestone) to be treated, means 15 for rotating the body means 13, shroud means 17 for covering one end of the body means 13, and arm means 19 fixedly attached to the body means 13 for rotation therewith.

The body means 13 preferably consists of an elongated, cylindrical member having a first end 21 for receiving a quantity of material (e.g., limestone) to be treated and having an opened, second end 23 for allowing particles of the material to exit the body means 13 after the material has been treated. It should be noted that the first end 21 of the body means 13 is provided with an access opening (not shown) for allowing the quantity of material to be introduced into the interior of the body means 13. The body means 13 is preferably constructed of a conventional refractory material in a manner, size and shape well known to those skilled in the art and is preferably positioned above a supporting surface S (see FIG. 1) with the opened, second end 23 thereof being lower than the first end 21 thereof so that the force of gravity will cause the material within the body means 13 to move toward the opened, second end 23 of the body means 13. The body means 13 preferably includes a nose ring 25 fixedly attached to the opened, second end 23 thereof in a position as clearly shown in FIGS. 1 and 2.

The means 15 for rotating the body means 13 may consist of any such means well known to those skilled in the art. For example, the means 15 may include one or more rollers 27 operatively engaging the body means 13 and may include a motor 29 for rotatably driving the rollers 27 (see FIG. 1) thereby causing the body means to rotate in the direction as shown by the arrow 30 in FIG. 2.

The shroud means 17 is for covering the opened, second end 23 of the body means 13 and is nonrotatably coupled to the body means 13 adjacent the opened, second end 23 thereof preferably by a bushing 31 or the like (see FIG. 1). The shroud means 17 includes grate means 33 for allowing particles of the material (e.g., the particles of quicklime QL) of a certain maximum size to pass therethrough. The grate means 33 is preferably located adjacent the lowermost portion of the opened, second end 23 of the body means 15 as clearly shown in FIGS. 1 and 2. The grate means 33 preferably includes a plurality of sized openings 35 for allowing the particles of quicklime QL or the like to pass therethrough. The sized openings 35 may be of any desired size. For example, when the rotary kiln 11 is used in the paper mill industry to decompose limestone LS into particles of quicklime QL, the openings 35 may be varied from 3 in. by 5 in. (7.62 cm. by 12.70 cm) to $6\frac{7}{8}$ in. by 5 in. (17.4625 cm. by 12.70 cm.). The openings 35 in the grate means 33 may be varied from smallest to largest in the direction of rotation of the body member 13 as shown by the arrow 30 in FIG. 2. That is, the openings 35' in FIG. 2 may be of the 3 in. by 5 in. size and the openings 35' in FIG. 2 may be of the $6\frac{7}{8}$ in. by 5 in. size.

The shroud means 17 also includes a chute means 37 for allowing particles of the material (e.g., particles of quicklime QL) of a size greater than the maximum size capable of passing through the grate means 33 to pass therethrough. The chute means 37 is preferably located substantially next to the grate means 33 in the direction of rotation of the body means 13 as clearly shown in FIG. 2. The chute means 35 is of a size large enough to allow any particle of quicklime QL or the like formed within the body means 13 to pass therethrough. The chute means 37 preferably includes a blade-like portion 39 located on the side of the chute means 37 that is farthest from the grate means 33 as clearly shown in FIG. 2 and for reasons which will hereinafter become apparent. A door member 41 may be swingably mounted in any manner apparent to those skilled in the art to the chute means 37 adjacent its outer end as shown in FIG. 2.

The arm means 19 is fixedly attached to the body means 13 for rotation therewith in such a manner so as to move any particles of the material (e.g., particles of quicklime QL) of a size greater than the maximum size capable of passing through the grate means 33 from the grate means 33 to the chute means 37. The arm means 19 preferably is formed of rigid material, as steel or the like, and preferably includes a first elongated arm member 43 and a second elongated arm member 45 fixedly attached to the opened, second end 23 of the body means 13. Preferably, the first and second elongated arm members 43, 35 are fixedly attached to the nose ring 25 of the body means 13 and are located substantially 180° apart from one another as clearly shown in FIG. 2. Each of the first and second elongated arm members 43, 45 extend outwardly of the opened, second end 23 of the body means 13 so that they will pass over the grate means 33 and the chute means 37 of the shroud means 17 (see FIG. 1) as the body means 13 rotates so as to move by pushing, thrusting or the like any particles of the material (e.g., the particles of quicklime QL) of a size greater than the maximum size capable of passing through the grate means 33 to the chute means 37. Each of the first and second elongated arm means 43, 45 preferably includes a base portion 47 and a substantially blade-like portion 49 (see FIG. 3) fixedly attached to base portion 47, as by welding or the like or may be integral therewith. The base portion 47 is for fixed attachment to the nose ring 25 of the body means 13 in any manner well known to those skilled in the art such as by the bolts 51. The blade-like portion 49 extends outwardly from the base portion 47 as clearly shown in FIGS. 1 and 3 to push the particles of the material (e.g., the particles of quicklime QL) of a size greater than the maximum size capable of passing through the grate means 33 to the chute means 37. The blade-like portions 49 of the first and second elongated arm members 43, 45 coact with the substantially blade-like portion 39 of the chute means 37 to shear in two any particles of the material (e.g., particles of quicklime QL) that are of a size too large to easily pass through the chute means 37. The blade-like portion 49 of each of the first and second elongated arm members 43, 45 are preferably fixed to the opened, second end of the body means 13 so as to be located at an angle relative to the blade-like portion 39 of the chute means 37 as clearly shown in FIG. 2 so as to increase the shearing effect between the blade-like portions 49 of the first and second elongated arm members 43, 45 and the blade-like portion 39 of the chute means 37 in a manner which should be apparent to those skilled in the art.

The rotary kiln 11 preferably includes a crusher means 53 positioned adjacent the outer end of the chute means 37 (see FIG. 2) for crushing any particles of the material (e.g., particles of quicklime QL) which pass through the chute means 37. The crusher means 53 may be of any construction well known to those skilled in the art. For example, the crusher means 53 may include a basket-like member 54 having an access port 54' for allowing particles of the material to be crushed to enter the basket-like member 54 and having a discharge port 54'' for allowing the crushed material to exit the basket-like member 54. A drive member 55 may be operatively coupled to the basket-like member 54 for driving crusher blades of the like (not shown) provided within the basket-like member 54 to crush the material within the basket-like member 54.

The rotary kiln 11 also may include a conveyor means 57 positioned adjacent to and beneath the grate means 33 of the shroud means 17 and the crusher means 53 (see FIGS. 1 and 2) for conveying particles of material (e.g., particles of quicklime QL) passing from the grate means 33 and the crusher means 53. The conveyor means 57 may be constructed in any manner well known to those skilled in the art and is used to convey the treated material (e.g., the quicklime QL) to a storage bin or the like.

As thus constructed and used, the present invention provides a rotary kiln which automaticallly sweeps large lumps of material such as quicklime from the discharge end of the kiln body into a chute which allows the lumps to pass to a crusher thereby eliminating the task of manually draggin these lumps from the discharge end of the kiln body.

Although the invention has been described and illustrated with respect to a preferred embodiment thereof, it is not to be so limited since changes and modifications may be made therein which are within the full intended scope of the invention.

I claim:

1. A rotary kiln for treating material, said kiln comprising:

(a) hollow body means for receiving a quantity of material to be treated, said body means including an opened end for allowing the material to exit said body means after it has been treated;

(b) means for rotating said body means;

(c) shroud means for covering said opened end of said body means, said shroud means including grate means for allowing particles of the material of a certain maximum size to pass therethrough and including chute means for allowing particles of the material of a size greater than the maximum size capable of passing through said grate means to pass theretherough; and (d) arms means fixedly attached to said body means for rotation therewith and for moving any particles of the material of a size greater than the maximum size capable of passing through said grate means to said chute means, said arm means including a first elongated arm member fixedly attached to said opened end of said body means and including a second elongated arm member fixedly attached to said opened end of said body means, said first and second elongated arm members extending outwardly of said opened end of said body means for passage over said grate means and said chute means when said body means rotates to move any particles of the material of a size greater than the maximum size capable of passing through said grate means to said chute means, each of said first and second elongated arm members including a substantially bladelike portion; said chute means includes a substantially blade-like portion for coacting with said substantially blade-like portions of said first and second elongated arm members to shear in two any particles of the material that are of a size too large to easily pass through said chute means.

2. The rotary kiln of claim 1 in which said substantially blade-like portions of said first and second elongated arm members are angled relative to said substantially blade-like portion of said chute means to increase the shearing effect therebetween.

3. An improved rotary kiln of the type including a hollow body means for receiving a quantity of material to be treated and having an opened end for allowing said material to exit said body means after said material has been treated, means for rotating said body means, and shroud means for covering said opened end of said body means and having grate means for allowing particles of said material of a certain maximum size to pass therethrough, wherein the improvement comprises:

(a) chute means provided in said shroud means for allowing particles of said material of a size greater than the maximum size capable of passing through said grate means to pass therethrough; and (b) arm means fixedly attached to said body means for rotation therewith and for moving any particles of said material of a size greater than the maximum size capable of passing through said grate means to said chute means.

4. The improved rotary kiln of claim 3 in which said arm means includes first and second elongated arm members fixedly attached to said opened end of said body means, and first and second elongated arm members extending outwardly of said opened end of said body means for passage over said grate means and said chute means when said body means is rotated to move any particles of said material of a size greater than the maximum size capable of passing through said grate means to said chute means.

5. An improved rotary kiln of the type including a hollow body means for receiving a quantity of material to be treated and having an opened end for allowing said material to exit said body means after said material has been treated, means for rotating said body means, and shroud means for covering said opened end of said body means and having grate means for allowing particles of said material of a certain maximum size to pass therethrough, wherein the improvement comprises:

(a) chute means provided in said shroud means for allowing particles of said material of a size greater than the maximum size capable of passing through said grate means to pass therethrough; and (b) arm means fixedly attached to said body means for rotation therewith and for moving any particles of said material of a size greater than the maximum size capable of passing through said grate means to said chute means, said arm means including first and second elongated arm members fixedly attached to said opened end of said body means, said first and second elongated arm members extending outwardly of said opened end of said body means for passage over said grate means and said chute means when said body means is rotated to move any particles of said material of a size greater than the maximum size capable of passing through said grate means to said chute means, each of said first and second elongated arm members including a substantially blade-like portion; said chute means including a substantially blade-like portion for coacting with said blade-like portions of said first and second arm members to shear in two any particles of said material that are of a size too large to easily pass through said chute means.

* * * * *